US007831052B2

(12) United States Patent
Puder

(10) Patent No.: US 7,831,052 B2
(45) Date of Patent: Nov. 9, 2010

(54) METHOD AND ACOUSTIC SYSTEM FOR GENERATING STEREO SIGNALS FOR EACH OF SEPARATE SOUND SOURCES

(75) Inventor: Henning Puder, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1192 days.

(21) Appl. No.: 11/269,058

(22) Filed: Nov. 8, 2005

(65) Prior Publication Data

US 2006/0120535 A1 Jun. 8, 2006

(30) Foreign Application Priority Data

Nov. 8, 2004 (DE) ..... 10 2004 053 790

(51) Int. Cl.
*H04R 5/00* (2006.01)

(52) U.S. Cl. ..... 381/23.1; 381/17; 381/18; 381/26

(58) Field of Classification Search ..... 381/17, 381/1, 18, 23.1–311
See application file for complete search history.

(56) References Cited

U.S. PATENT DOCUMENTS 5,999,956 A 12/1999 Deville
6,526,148 B1 * 2/2003 Jourjine et al. ..... 381/94.7
6,704,369 B1 * 3/2004 Kawasaki et al. ..... 375/285
2007/0100605 A1 * 5/2007 Renevey et al. ..... 704/201

FOREIGN PATENT DOCUMENTS

EP 1 326 478 3/2003
EP 1 509 065 8/2003

OTHER PUBLICATIONS

"Adaptive Signal Processing," Benesty et al., pp. 195-225 (2003).
"Strategy-Selective Noise Reduction For Binaural Digital Hearing Aids" Wittkop, Speech Communication, vol. 39 (2003), pp. 111-138.

* cited by examiner

*Primary Examiner*—Xu Mei
*Assistant Examiner*—Paul Kim
(74) *Attorney, Agent, or Firm*—Schiff Hardin LLP

(57) ABSTRACT

In a method and an acoustic system that generate a stereo signal for each of multiple. separate sources, a blind source separation of at least two microphone signals is conducted to acquire BSS filters. Each of the microphone signals is filtered with its own filter transfer function that is the quotient of a power density spectral portion of the respective sound source and the overall power density spectrum of the respective microphone signal, such that two stereo signals are obtained for each microphone signal. An approximation of the signals to be separated, for example for each of two hearing devices, is thereby possible.

10 Claims, 3 Drawing Sheets

METHOD AND ACOUSTIC SYSTEM FOR GENERATING STEREO SIGNALS FOR EACH OF SEPARATE SOUND SOURCES

BACKGROUND OF THE INVENTION

1. Field of the Invention

The present invention concerns a method for respectively generating stereo signals for at least two sound sources. Moreover, the present invention concerns a corresponding acoustic system for generation of stereo signals. The present invention in particular concerns hearing devices such as hearing aid devices.

2. Description of the Prior Art

A method for generating respective mono (monaural) signals for each of multiple sound sources is known from the essay by J. Benesty, Y. Huang: Adaptive Signal Processing: Berlin, N.Y., pages 195-23, 2003. The BSS methods (blind source separation) described therein can separate and individually reproduce spatially-separate but temporally-overlapping sources. Such a BSS method can be used, for example, as a binaural feed or especially for a binaural directional microphone, whereby a microphone signal from the right hearing device is used as well as a microphone signal from the left hearing device.

A problem that still has yet to be solved is that the BSS method provides only a mono signal for each of the separate sources. If the hearing device user were to be identically provided with this signal at both hearing devices, the user could in fact perceive the sources with very good separation, but spatial localization of the sources would not be possible. For this purpose, the right and left signals would have to be differentiated at the inter-aural level and delay differences that are typical for natural signals would have to be introduced.

Alternative methods to the BSS methods for binaural directional microphony exhibit a very limited capability and for this reason (as well as due to the usually absent wireless connection between hearing devices) are not used.

SUMMARY OF THE INVENTION

An object of the present invention is to provide a method and acoustic sound system for better perception capability of separate sound sources.

This object is inventively achieved by a method for generation of respective stereo signals for at least two separate sound sources by conducting a blind source separation of at least two microphone signals to acquire transfer functions of filters of a first filter device, determining transfer functions of filters of a second filter device, using the transfer functions of the filters of the first filter device (the transfer functions of the filters of the second filter device respectively corresponding to the quotients of a power density spectral fraction of the respective sound sources and the overall power density spectrum of the respective microphone signals, and filtering the at least two microphone signals, respectively with at least two filters of the second filter device, such that two stereo signals are obtained for each microphone signal.

The above object also is inventively achieved by a method for generation of stereo signals for at least two separate sound sources by conducting a blind source separation of at least two microphone signals using a first filter device for acquisition of two mono output signals, and respectively filtering the mono output signals with at least two second filters of a second filter device, the transfer functions of which are calculated from the transfer functions of the filters of the first filter device, such that two stereo signals are attained for each mono output signal. The transfer functions from the sound sources to the microphones can be calculated and multiplied with the mono output signals, so the transfer functions of the second filters can be obtained.

The above object also is inventively achieved by an acoustic system for generation of respective stereo signals for at least two separate sound sources, having a microphone device that provides at least two microphone signals, a first filter device for blind source separation of the at least two microphone signals based on transfer functions of filters of the first filter device, a second filter device for filtering of each of the microphone signals such that two stereo signals are generated for each microphone signal, and a calculation device computer to determine the transfer functions of filters of the second filter device using the transfer functions of the filters of the first filter device, the transfer functions of the filter of the second filter device respectively corresponding to the quotients of a power density spectral portion of the respective sound sources and the overall power density spectrum of the respective microphone signals.

The above object also is inventively achieved by an acoustic system for generation of respective stereo signals for at least two separate sound sources, having a microphone device that provides at least two microphone signals, a first filter device for blind source separation of the at least two microphone signals based on the transfer functions of filters of the first filter device to produce two mono output signals, a second filter device for filtering of each of the microphone signals such that two stereo signals are generated from each mono output signal, and a calculation device to determine the transfer functions of filters of the second filter device using the transfer functions of the filters of the first filter device.

The approximation of the signals to be separated, for example for each hearing device, headset or the like, is possible by means of inventive method and the inventive acoustic system.

DESCRIPTION OF THE PREFERRED EMBODIMENTS

The exemplary embodiments subsequently illustrated in detail represent preferred embodiments of the present invention.

A BSS method is used to realize a binaural directional microphone with stereo or, respectively, binaural reproduction. BSS methods can generally be explained using FIG. 1. Reference is made again in this regard to the essay by J. Benesty and Y. Huang. The signal transfer from two signal sources to two microphones is correspondingly described via the signal model SIG. The further processing from the microphones to the output is shown by a BSS model BSS.

The signals s1($k$) of the first signal source and the signals s2($k$) of the second signal source are correspondingly transferred to both microphones, whereby k represents sample points in time. The transfer functions in the spectral range for the individual transfer paths can be symbolized by signal model filters $H_{ij}(\Omega)$. At the microphones, the signals of both signal sources can be additively superimposed on the microphone signals x1($k$) and x2($k$).

Figure 1:
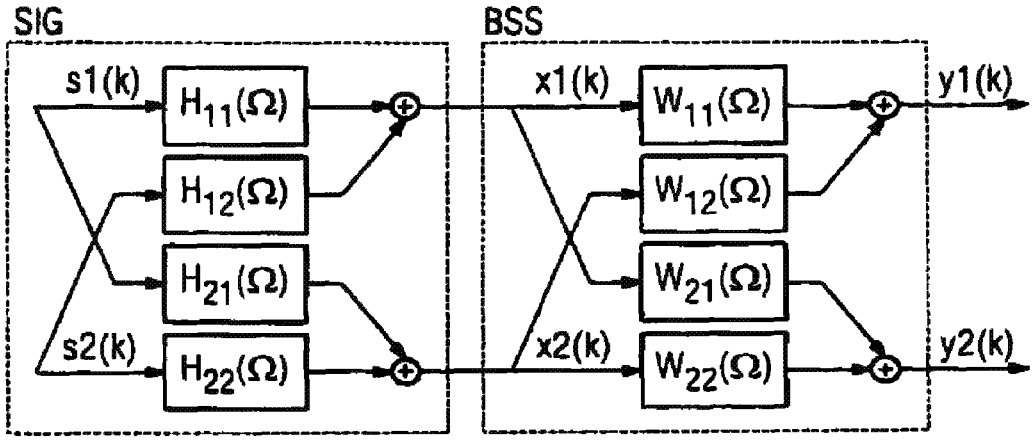
FIG 1 (PRIOR ART)
FIG. 1 is a block diagram representing a signal model and a BSS method according to the prior art.

The BSS model corresponding to FIG. 1 is now applied in order to now again separate the individual signal portions. A mono output signal y1($k$) and y2($k$) is thereby respectively determined for each source from the microphone signals x1($k$) and y2($k$) with the aid of adaptive BSS filters $W_{ij}(\Omega)$.

The following correlation between the signal model filters $H_{ij}(\Omega)$ and the adaptive BSS filters $W_{ij}(\Omega)$ applies for BSS:

$$\begin{bmatrix} Y1(\Omega) \\ Y2(\Omega) \end{bmatrix} = \begin{bmatrix} W_{11}(\Omega) & W_{12}(\Omega) \\ W_{21}(\Omega) & W_{22}(\Omega) \end{bmatrix} \begin{bmatrix} H_{11}(\Omega) & H_{12}(\Omega) \\ H_{21}(\Omega) & H_{22}(\Omega) \end{bmatrix} \begin{bmatrix} S1(\Omega) \\ S2(\Omega) \end{bmatrix} = \begin{bmatrix} c_1(\Omega) & 0 \\ 0 & c_2(\Omega) \end{bmatrix} \begin{bmatrix} S1(\Omega) \\ S2(\Omega) \end{bmatrix}$$

BSS methods now determine the filter values $W_{11}(\Omega)$, $W_{12}(\Omega)$, $W_{21}(\Omega)$ and $W_{22}(\Omega)$. The signal model filters $H_{11}(\Omega)$, $H_{12}(\Omega)$, $H_{21}(\Omega)$ and $H_{22}(\Omega)$ and the complex weightings $c_1(\Omega)$ and $c_2(\Omega)$ of the signals after separation. The matrix equation above can now be solved for $H_{11}(\Omega)$, $H_{12}(\Omega)$, $H_{21}(\Omega)$ and $H_{22}(\Omega)$. The result of this is:

$$H_{11}(\Omega) = \frac{c_1(\Omega)W_{22}(\Omega)}{W_{11}(\Omega)W_{22}(\Omega) - W_{21}(\Omega)W_{12}(\Omega)} = c_1(\Omega)\tilde{H}_{11}(\Omega)$$

$$H_{21}(\Omega) = \frac{c_1(\Omega)W_{21}(\Omega)}{W_{21}(\Omega)W_{12}(\Omega) - W_{11}(\Omega)W_{22}(\Omega)} = c_1(\Omega)\tilde{H}_{21}(\Omega)$$

$$H_{12}(\Omega) = \frac{c_2(\Omega)W_{12}(\Omega)}{W_{21}(\Omega)W_{12}(\Omega) - W_{11}(\Omega)W_{22}(\Omega)} = c_2(\Omega)\tilde{H}_{12}(\Omega)$$

$$H_{22}(\Omega) = \frac{c2(\Omega)W_{11}(\Omega)}{W_{11}(\Omega)W_{22}(\Omega) - W_{21}(\Omega)W_{12}(\Omega)} - c_2(\Omega)\tilde{H}_{22}(\Omega)$$

It is the goal to obtain stereo signals that are transferred to the right and left hearing devices and allow a spatial perception by the hearing device user.

Two method versions are now introduced in the following with which it is possible to calculate the desired binaural signals for both separate sources.

Figure 2:
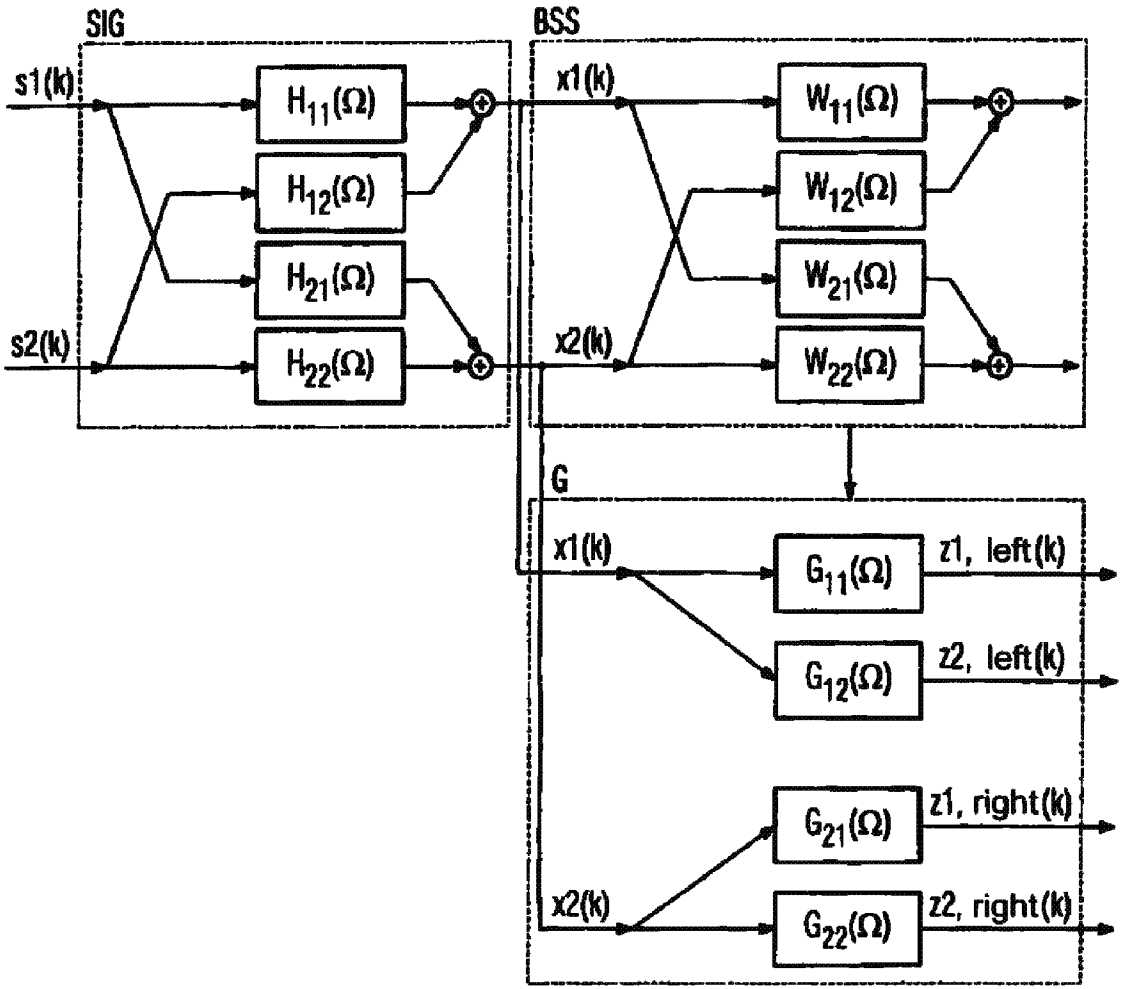
FIG. 2 is a block diagram showing a first embodiment of an inventive acoustic system to provide a binaural output (stereo output).

1) Calculation of the Stereo or, Respectively, Binaural Signals with the Aid of Wiener Filters Corresponding to the first method according to FIG. 2, the Wiener filters are calculated for the BSS method. The output signals y1($k$) and y2($k$) of the BSS method are no long necessary for the further processing. However, the filters $W_{ij}(\Omega)$ of the BSS with i=1, 2 and j=1, 2 are used. Post-processing filters $G_{ij}(\Omega)$ with i=1, 2 and j=1, 2 are calculated from the filter values $W_{ij}(\Omega)$ as this is indicated in FIG. 2 by the arrow from the filter BSS to the filter G.

Via the filter G, the left microphone signal x1($k$) and the right microphone signal x2($k$) are now filtered such that the stereo output signals z1left(k), z1right(k), z2left(k) and z2right(k) for the binaural feed or stereo feed result. For this the left microphone signal x1($k$) is filtered by the filter units $G_{11}(\Omega)$ and $G_{12}(\Omega)$. The right microphone signal x2($k$) is accordingly filtered by the filter units $G_{21}(\Omega)$ and $G_{22}(\Omega)$ in order to obtain the stereo signals of the individual sound sources for the right channel.

If the above equations are used, the power density spectra $S_{x1x1}(\Omega)$ and $S_{x2x2}(\Omega)$ of both microphone signals x1($k$) and x2($k$) can be written as follows:

$$S_{x1x1}(\Omega)=|\tilde{H}_{11}(\Omega)|^2|c_1(\Omega)|^2S_{s1s1}(\Omega)+|\tilde{H}_{12}(\Omega)|^2|c_2(\Omega)|^2S_{s2s2}(\Omega)$$

$$S_{x2x2}(\Omega)=|\tilde{H}_{21}(\Omega)|^2|c_1(\Omega)|^2S_{s1s1}(\Omega)+|\tilde{H}_{22}(\Omega)|^2|c_2(\Omega)|^2S_{s2s2}(\Omega)$$

$S_{s1s1}(\Omega)$ and $S_{s2s2}(\Omega)$ thereby mean the power density spectra of both signal sources.

If these equations are now solved for the unknown values $S_{s1s1}(\Omega)|c_1(\Omega)|^2$ and $S_{s2s2}(\Omega)|c_2(\Omega)|^2$, the following results:

$$S_{x1x1}(\Omega)|c_1(\Omega)|^2 = \frac{S_{x1x1}(\Omega)|\tilde{H}_{22}(\Omega)|^2 - S_{x2x2}(\Omega)|\tilde{H}_{12}(\Omega)|^2}{|\tilde{H}_{11}(\Omega)|^2|\tilde{H}_{22}(\Omega)|^2 - |\tilde{H}_{21}(\Omega)|^2|\tilde{H}_{12}(\Omega)|^2}$$

$$S_{x2x2}(\Omega)|c_2(\Omega)|^2 = \frac{S_{x2x2}(\Omega)|\tilde{H}_{11}(\Omega)|^2 - S_{x1x1}(\Omega)|\tilde{H}_{21}(\Omega)|^2}{|\tilde{H}_{11}(\Omega)|^2|\tilde{H}_{22}(\Omega)|^2 - |\tilde{H}_{21}(\Omega)|^2|\tilde{H}_{12}(\Omega)|^2}$$

The portions of the power density spectra of the microphone signals can thus be calculated as follows:

1. Power density spectral portion from s1($k$) into x1($k$):

$$P_{11}(\Omega) = |\tilde{H}_{11}(\Omega)|^2|c_1(\Omega)|^2S_{x1x1}(\Omega) = |\tilde{H}_{11}(\Omega)|^2\frac{S_{x1x1}(\Omega)|\tilde{H}_{22}(\Omega)|^2 - S_{x2x2}(\Omega)|\tilde{H}_{12}(\Omega)|^2}{|\tilde{H}_{11}(\Omega)|^2|\tilde{H}_{22}(\Omega)|^2 - |\tilde{H}_{21}(\Omega)|^2|\tilde{H}_{12}(\Omega)|^2}$$

2. Power density spectral portion from s2($k$) into x1($k$):

$$P_{12}(\Omega) = |\tilde{H}_{12}(\Omega)|^2|c_2(\Omega)|^2S_{x2x2}(\Omega) = |\tilde{H}_{12}(\Omega)|^2\frac{S_{x2x2}(\Omega)|\tilde{H}_{11}(\Omega)|^2 - S_{x1x1}(\Omega)|\tilde{H}_{21}(\Omega)|^2}{|\tilde{H}_{11}(\Omega)|^2|\tilde{H}_{22}(\Omega)|^2 - |\tilde{H}_{21}(\Omega)|^2|\tilde{H}_{12}(\Omega)|^2}$$

3. Power density spectral portion from s1($k$) into x2($k$):

$$P_{21}(\Omega) = |\tilde{H}_{21}(\Omega)|^2|c_1(\Omega)|^2S_{s1s1}(\Omega) = |\tilde{H}_{21}(\Omega)|^2\frac{S_{x1x1}(\Omega)|\tilde{H}_{22}(\Omega)|^2 - S_{x2x2}(\Omega)|\tilde{H}_{12}(\Omega)|^2}{|\tilde{H}_{11}(\Omega)|^2|\tilde{H}_{22}(\Omega)|^2 - |\tilde{H}_{21}(\Omega)|^2|\tilde{H}_{12}(\Omega)|^2}$$

4. Power density spectral portion from s2($k$) into x2($k$):

$$P_{22}(\Omega) = |\tilde{H}_{22}(\Omega)|^2|c_2(\Omega)|^2S_{s2s2}(\Omega) = |\tilde{H}_{22}(\Omega)|^2\frac{S_{x2x2}(\Omega)|\tilde{H}_{11}(\Omega)|^2 - S_{x1x1}(\Omega)|\tilde{H}_{21}(\Omega)|^2}{|\tilde{H}_{11}(\Omega)|^2|\tilde{H}_{22}(\Omega)|^2 - |\tilde{H}_{21}(\Omega)|^2|\tilde{H}_{12}(\Omega)|^2}$$

The four Wiener filters for extraction of the signal portions of S1(Ω) and S2(Ω) from the microphone signals X1(Ω) and X2(Ω) thus result into:

1. Calculation of the signal portion of S1(Ω) in the first microphone: application of the following filter to the signal X1(Ω):

$$G_{11}(\Omega) = \frac{P_{11}(\Omega)}{S_{x1x1}(\Omega)}$$

2. Calculation of the signal portion of S2(Ω) in the first microphone: application of the following filter to the signal X1(Ω):

$$G_{12}(\Omega) = \frac{P_{12}(\Omega)}{S_{x1x1}(\Omega)}$$

3. Calculation of the signal portion of S1(Ω) in the second microphone: application of the following filter to the signal X2(Ω):

$$G_{21}(\Omega) = \frac{P_{21}(\Omega)}{S_{x2x2}(\Omega)}$$

4. Calculation of the signal portion of S2(Ω) in the second microphone: application of the following filter to the signal X2(Ω):

$$G_{22}(\Omega) = \frac{P_{22}(\Omega)}{S_{x2x2}(\Omega)}$$

All necessary values, i.e. the filter values $W_{ij}(\Omega)$ from which the values $\tilde{H}_{ij}(\Omega)$ are calculated as well as the power density spectra $S_{x1x1}(\Omega)$ and $S_{x2x2}(\Omega)$, are available at any point in time or can be instantly approximated.

Given this application of the Wiener filtering, the known artifacts as they are known from classical known reduction methods do not occur since all necessary power density spectra can be instantaneously approximated. They do not have to be approximated in a smoothed manner and a discontinuation of the approximation during specific time segments is not necessary.

Figure 3:
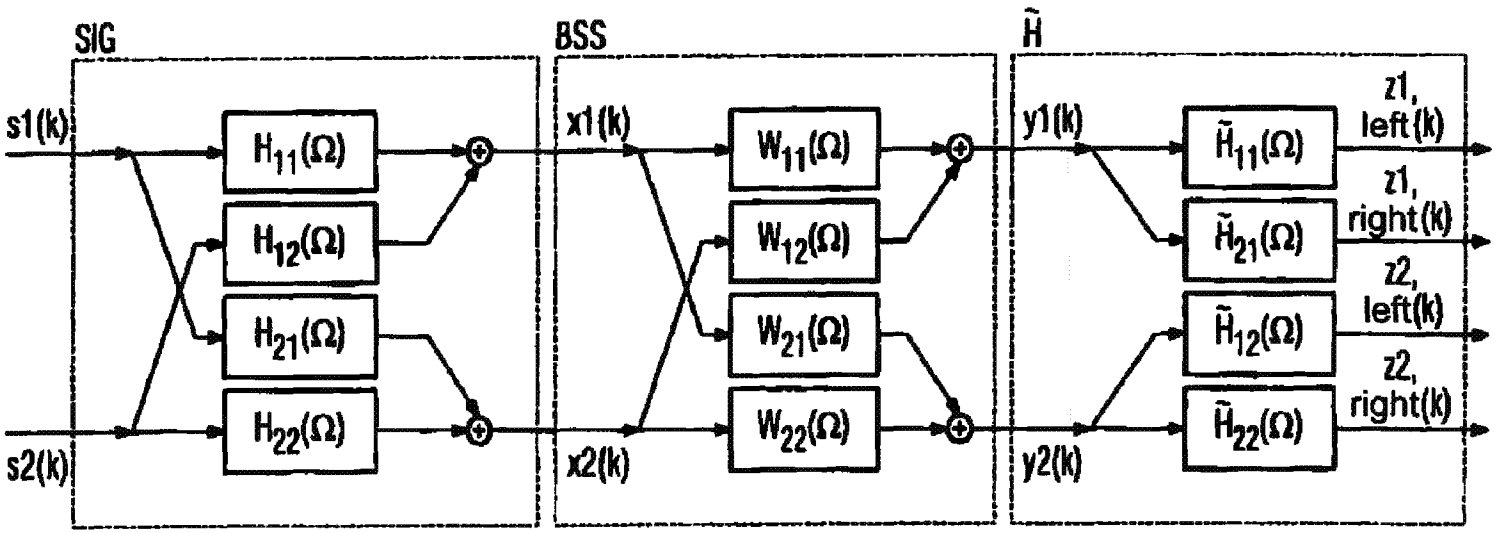
FIG. 3 is a block diagram of a second embodiment of an inventive acoustic system to provide a binaural output (stereo output).

2) Direct Calculation of the Stereo (Binaural) Output Signals Based on the Mono Output Signals of the BSS Method and the Approximated Filter Values $W_{ij}(\Omega)$ According to FIG. 3, the binaural signal portions or, respectively, stereo signal portions z1left(k), z1right(k), z2left(k) and z2right(k) can alternatively also be directly calculated according to the following with the aid of the output signals of the BSS method, y1(*k*) and y2(*k*), as well as the filter values $W_{ij}(\Omega)$ implicitly approximated in the BSS method:

1. Calculation of the signal portion of S1(Ω) in the first microphone:

$$\begin{aligned} S1(\Omega)H_{11}(\Omega) &= \frac{Y1(\Omega)}{c_1(\Omega)} c_1(\Omega)\tilde{H}_{11}(\Omega) \\ &= Y1(\Omega)\tilde{H}_{11}(\Omega) \\ &= \frac{Y1(\Omega)W_{22}(\Omega)}{W_{11}(\Omega)W_{22}(\Omega) - W_{21}(\Omega)W_{12}(\Omega)} \end{aligned}$$

2. Calculation of the signal portion of S1(Ω) in the second microphone:

$$\begin{aligned} S1(\Omega)H_{21}(\Omega) &= \frac{Y1(\Omega)}{c_1(\Omega)} c_1(\Omega)\tilde{H}_{21}(\Omega) \\ &= Y1(\Omega)\tilde{H}_{21}(\Omega) \\ &= \frac{Y1(\Omega)W_{21}(\Omega)}{W_{21}(\Omega)W_{12}(\Omega) - W_{11}(\Omega)W_{22}(\Omega)} \end{aligned}$$

3. Calculation of the signal portion of S2(Ω) in the first microphone:

$$\begin{aligned} S2(\Omega)H_{12}(\Omega) &= \frac{Y2(\Omega)}{c_2(\Omega)} c_2(\Omega)\tilde{H}_{12}(\Omega) \\ &= Y2(\Omega)\tilde{H}_{12}(\Omega) \\ &= \frac{Y2(\Omega)W_{12}(\Omega)}{W_{21}(\Omega)W_{12}(\Omega) - W_{11}(\Omega)W_{22}(\Omega)} \end{aligned}$$

4. Calculation of the signal portion of S2(Ω) in the second microphone:

$$\begin{aligned} S2(\Omega)H_{22}(\Omega) &= \frac{Y2(\Omega)}{c_2(\Omega)} c_2(\Omega)\tilde{H}_{22}(\Omega) \\ &= Y2(\Omega)\tilde{H}_{22}(\Omega) \\ &= \frac{Y2(\Omega)W_{11}(\Omega)}{W_{11}(\Omega)W_{22}(\Omega) - W_{21}(\Omega)W_{12}(\Omega)} \end{aligned}$$

The output signals of the BSS method y1(*k*), y2(*k*) (Y1(Ω) and Y2(Ω) in the spectral range) are thus further processed by the filter device $\tilde{H}$. This means that the mono output signal y1(*k*) concerning the signal source $S_1$ is filtered by the filters $\tilde{H}_{11}(\Omega)$ and $\tilde{H}_{21}(\Omega)$ such that the stereo signals z1left(k) and z1right(k) result for the signal source $S_1$. The mono output signal y2(*k*) is analogously filtered by both filters $\tilde{H}_{12}(\Omega)$ and $\tilde{H}_{22}(\Omega)$, such that the stereo signals z2left(k) and z2right(k) result for the signal source $S_2$.

The filters $W_{ij}(\Omega)$ (implicitly approximated in the BSS method) that describe the transfer functions from the sources to the microphones are thus used to calculate the filters $H_{ij}(\Omega)$. If these are multiplied with the approximated mono signals Y1(Ω) and Y2(Ω) corresponding to the equations above, the desired binaural signals are obtained. This calculation is possible since the missing compensation factors c1 and c2 for determination of the filter values $H_{ij}(\Omega)$ and the source signals S1(Ω) and S2(Ω) directly cancel in the multiplication.

Although modifications and changes may be suggested by those skilled in the art, it is the intention of the inventor to embody within the patent warranted hereon all changes and modifications as reasonably and properly come within the scope of his contribution to the art.

I claim as my invention:

1. A method for generating respective stereo signals for at least two separate sound sources, comprising the steps of:

conducting a blind source separation of at least two microphone signals to acquire transfer functions of filters of a first filter device;

calculating transfer functions of filters of a second filter device using the transfer functions of the filters of the first filter device, the transfer functions of the filters of the second filter device respectively corresponding to quotients of a power density spectral portion of the respective sound sources and the overall power density spectrum of the respective microphone signals, and filtering the at least two microphone signals, respectively with at least two filters of the second filter device, to obtain two stereo signals for each microphone signal.

2. A method as claimed in claim 1 comprising employing Wiener filters as at least one of said filters of said first filter device and said filters of said second filter device.

3. A method for generating respective stereo signals for at least two separate sound sources, comprising the steps of:

conducting a blind source separation of at least two microphone signals with a first filter device to acquire two mono output signals; and respectively filtering of the mono output signals with at least two second filters of a second filter device; and calculating transfer functions for the filters of the second filter device from the transfer functions of the filters of the first filter device to obtain two stereo signals for each mono output signal.

4. A method as claimed in claim 3 comprising employing Wiener filters as at least one of said filters of said first filter device and said filters of said second filter device.

5. An acoustic system for generating respective stereo signals for at least two separate sound sources, comprising:

a microphone device that provides at least two microphone signals;

a first filter device for blind source separation of the at least two microphone signals based on the transfer functions of filters of the first filter device;

a second filter device for filtering of each of the microphone signals to obtain two stereo signals for each microphone signal; and a calculation device that calculates the transfer functions of filters of the second filter device from the transfer functions of the filters of the first filter device, the transfer functions of the filters of the second filter device respectively corresponding to quotients of a power density spectral portion of the respective sound sources and the overall power density spectrum of the respective microphone signals.

6. An acoustic system as claimed in claim 5 wherein at least one of said filters of said first filter device or said filters of said second filter device are Wiener filters.

7. An acoustic system as claimed in claim 5 wherein said sound sources are hearing devices.

8. An acoustic system for generating respective stereo signals for at least two separate sound sources, comprising:

a microphone device that provides at least two microphone signals;

a first filter device for blind source separation of the at least two microphone signals based on transfer functions of filters in the first filter device to obtain second two mono output signals;

a second filter device for filtering of each of the two mono output signals, using filters in the second filter device, to obtain two stereo signals for each of said two mono output signals signal; and a calculation device that calculates respective transfer functions of said filters in the second filter device from the transfer functions of the filters in the first filter device.

9. An acoustic system as claimed in claim 8 wherein at least one of said filters in said first filter device or said filters in said second filter device are Wiener filters.

10. An acoustic system as claimed in claim 8 wherein said sound sources are hearing devices.

* * * * *